US006805352B2

(12) United States Patent
Hunter

(10) Patent No.: US 6,805,352 B2
(45) Date of Patent: Oct. 19, 2004

(54) CRAPS GAME WITH PROGRESSIVE JACKPOT

(75) Inventor: Samuel C. Hunter, Panama City (PA)

(73) Assignee: Enlil-Enki Enterprises, S.A., Panama City (PA)

( * ) Notice: Subject to any disclaimer, the term of this patent is extended or adjusted under 35 U.S.C. 154(b) by 0 days.

(21) Appl. No.: 10/678,740

(22) Filed: Oct. 3, 2003

(65) Prior Publication Data

US 2004/0130094 A1 Jul. 8, 2004

Related U.S. Application Data

(60) Provisional application No. 60/319,598, filed on Oct. 6, 2002.

(51) Int. Cl.[7] ..... A63F 9/04

(52) U.S. Cl. ..... 273/274; 273/309; 273/146; 463/16; 463/40; 463/42

(58) Field of Search ..... 273/274, 309, 273/146; 463/16, 40, 42

(56) References Cited

U.S. PATENT DOCUMENTS

| | | | | |
|---|---|---|---|---|
| 4,334,685 A | | 6/1982 | Robbins et al. | |
| 4,635,938 A | | 1/1987 | Gray | |
| 5,308,081 A | | 5/1994 | Bartle | |
| 5,487,547 A | | 1/1996 | Hobert | |
| 5,490,670 A | | 2/1996 | Hobert | |
| 5,513,851 A | | 5/1996 | Harris | |
| 5,542,671 A | | 8/1996 | Stewart | |
| 5,573,248 A | * | 11/1996 | Parra et al. | 273/274 |
| 5,728,002 A | | 3/1998 | Hobert | |
| 5,785,596 A | | 7/1998 | Hobert | |
| 5,829,749 A | | 11/1998 | Hobert | |
| 6,234,482 B1 | | 5/2001 | Henderson | |

OTHER PUBLICATIONS

Chambliss, C.R. "Three–Dice Craps, A Possible New Casino Game," Gambling Research Proceedings of the Seventh International Conference on Gambling and Risk Taking, vol. 4, 360–373, Quantitative Analysis and Gambling, conference date and location: Aug. 23–26, 1987 at Bally's Grand Hotel and Casino, Reno, Nevada, 16 pages.

Craps Table Layout, printout from web site: http://www.learning–craps.com/table_layout.htm, printout date: Sep. 30, 2003, 8 pages.

Craps Terminology, printout from web site: http://www.learning–craps.com/terms.htm, printout date: Sep. 30, 2003, 3 pages.

Craps Rules and Fundamentals, printout from web site: http://www.learning–craps.com/rules.htm, printout date: Sep. 30, 2003, 6 pages.

* cited by examiner

*Primary Examiner*—Benjamin Layno
(74) *Attorney, Agent, or Firm*—Akin Gump Strauss Hauer & Feld, L.L.P.

(57) ABSTRACT

A progressive jackpot is awarded in a craps game. Three dice are used in the come-out roll. The progressive jackpot is funded with an ante from each player who places a bet in the craps game. A chance to win the progressive jackpot is initiated whenever a first predetermined outcome occurs in the come-out roll. The progressive jackpot is awarded to the current players if a roll subsequent to the come-out roll having a first predetermined outcome has a second predetermined outcome. The outcome of at least two of the dice in the come-out roll are used to determine the outcome of the craps game only if the come-out roll does not achieve the first predetermined outcome.

14 Claims, 6 Drawing Sheets

CRAPS GAME WITH PROGRESSIVE JACKPOT

CROSS-REFERENCE TO RELATED APPLICATIONS

This application claims the benefit of U.S. Provisional Application No. 60/319,598 filed Oct. 6, 2002 entitled "Dice Game with Progressive Jackpot."

BACKGROUND OF THE INVENTION

Craps is the most popular dice game that is known. Craps, having been brought to North America from Europe in the early 1700's, was first played on river boats and then moved west with the frontier.

There are two types of Craps that are currently played: "Street Craps;" and "Bank Craps." Street Craps is typically played in an informal setting where players play against each other. A bet that is made by one player is covered by another player. Street Craps cannot proceed unless another player covers the bet.

Bank Craps is played in a casino where betting is structured. All bets are covered by the casino, which is known as the bank. All players play against the bank.

In a game of Craps, an initial roll of the dice is referred to as a "come out" ("come-out") roll. The "result" of a roll of a pair of dice is defined to be the numeric sum of the markings on the face up sides of both dice. When, for example, a result of a roll of a pair of dice is the face up sides thereof having a sum of five spots, a "five" is said to have been rolled.

Pass Line Bet

A player may make a "pass line" bet that is won when the come out roll is either a 7 or 11. When the come out roll is a 2, 3 or 12, the player loses. When the come out roll is 4, 5, 6, 8, 9 or 10, a "point" is said to have been established. When the point is established, the dice are repeatedly rolled until either the point is rolled or a 7 is rolled. When the point is rolled, the player wins the pass line bet. When the 7 is rolled, the player loses the pass line bet.

True Odds Bet

When the player makes the pass line bet and the point is established, the player may make place cheques representative of a true odds bet behind cheques representative of the pass line bet. The player wins the true odds bet by winning the pass line bet. A payout on the true odds bet is in accordance with a true odds pay table which is given as:

| Established Point | Payout Odds |
|---|---|
| 4 | 2:1 |
| 5 | 3:2 |
| 6 | 6:5 |
| 8 | 6:5 |
| 9 | 3:2 |
| 10 | 2:1 |

Thus, for example, when the established point is 10, the player receives a two to one payout on the true odds bet in addition to winning the pass line bet when the 10 is rolled prior to 7 being rolled.

Come Bet

After the point is established, the player may make a "come" bet that is similar in many respects to a pass line bet.

As a first example, when there has been a come out roll that establishes a point and the player then makes the come bet, if the next roll is a 7, the player would win and everyone who made a pass line bet would lose.

As a second example, when there has been a come out roll that establishes a point and the player then makes the come bet, if the next roll is 11, the player would win but pass line bets would be unresolved.

As a third example, when there has been a come out roll that establishes a point and the player then makes the come bet, if the next roll is either a 2, 3 or 12, the player would lose the come bet but the pass line bets would be (remain) unresolved.

As a fourth example, when there has been a come out roll that establishes a point and the player then makes the come bet, if the next roll is either a 4, 5, 6, 8, 9, 10, a point is established that is only relevant to the come bet. The dice are repeatedly rolled until either the relevant point is rolled or a 7 is rolled. When the relevant point is rolled, the player wins the come bet. When the 7 is rolled, the player loses the come bet.

Don't Pass Line Bet

The player may make what is known as a "don't pass line" bet. The "don't pass" line bet is lost when the come out roll is either the 7 or 11. When the come out roll is 2 or 3, the player wins. When the come out roll is 12, the player recovers cheques representative of the "don't pass" line bet in what is called a push.

As in the pass line bet, when the come out roll is 4, 5, 6, 8, 9 or 10, the point is established. The dice are repeatedly rolled until either the point is rolled or the 7 is rolled. When the point is rolled, the player loses the "don't pass" line bet. When the 7 is rolled, the player wins the "don't pass" line bet.

Don't Come Bet

After the point is established, the player may make a "don't come" bet that is similar in many respects to a "don'y pass" line bet.

As a first example, when there has been a come out roll that establishes a point and the player then makes the "don't come" bet, when the next roll is 11, the player loses. Alternatively, if the next roll is a 7, both the "don't come" bet and any pass line bets are lost.

As a second example, when there has been a come out roll that establishes a point and the player then makes the "don't come" bet, if the next roll is either a 2, 3 or 12 the player would lose the "don't come" bet but the pass line bets would be (remain) unresolved.

As a third example, when there has been a come out roll that establishes a point and the player then makes the don't come bet, when the next roll is either a 4, 5, 6, 8, 9, 10, a point is established that is only relevant to the don't come bet. The dice are repeatedly rolled until either the relevant point is rolled or 7 is rolled. When the relevant point is rolled, the player loses the "don't come" bet. When the 7 is rolled, the player wins the "don't come" bet.

Place Bet

The player may make a "place" bet on a particular number being rolled (eligible numbers include: 4, 5, 6, 8, 9, and 10). The player wins the "place" bet when the particular number chosen is rolled prior to a "7" being rolled. If a "7" is rolled before the particular number chosen is rolled, the player loses the "place" bet. All "place" bets are "off" on the "come out" roll unless otherwise specified by the player.

Lay Bet

The player may make a "lay" bet on a particular number being rolled (eligible numbers include: 4, 5, 6, 8, 9, and 10). The player wins the "lay" bet when the "7" is rolled prior to the particular number being rolled. If the particular number is rolled before a "7" is rolled, the player loses. All "lay" bets are "off" on the "come out" roll unless otherwise specified by the player.

Field Bet

The player may make a "field" bet, at any time. When the player makes the field bet and the following roll is a 3, 4, 9, 10 or 11, the player wins an even money payout. When the next roll is either a 2 or a 12, the player wins a two to one payout. When the roll is a 5, 6, 7, or 8, the player loses.

Hard Way Bet

The player may make what is known as a "hard way" bet on a 4, 6, 8 or 10 after a point has been established. When the dice are rolled and each die produces a 2, for example, a hard way 4 is said to have been rolled. When the player bets on a hard way 4, the dice are repeatedly rolled until either the hard way 4 is rolled or:

(a) any other combination having a sum of four is rolled; or (b) the 7 is rolled.

When the hard way 4 is rolled, the player wins the hard way 4 bet. When any other combination having the sum of four or the 7 is rolled, the player loses the hard way 4 bet. A result of all other hard way bets is determined in a similar manner. All "hard way" bets are "off" on the "come out" roll unless otherwise specified by the player.

One Roll Bets

The player makes any of a plurality of one roll bets on a result of an ensuing roll.

Examples of the one roll bets are:

a 7 must be rolled to win;

a 2, 3 or 12 must be rolled to win;

a 2 must be rolled to win;

a 3 must be rolled to win;

a 12 must be rolled to win;

an 11 must be rolled to win;

a 2, 3, 11, or 12 must be rolled to win;

a 6 must be rolled to win; and an 8 must be rolled to win.

Jackpots

A jackpot is a cumulative pool or kitty in a game or competition. Jackpots associated with craps games are described in at least the following U.S. Pat. No. 6,234,482 (Henderson); U.S. Pat. No. 5,487,547 (Hobert); U.S. Pat. No. 5,490,670 (Hobert); U.S. Pat. No. 5,728,002 (Hobart); U.S. Pat. No. 5,785,596 (Hobart); U.S. Pat. No. 5,829,749 (Hobart) and U.S. Pat. No. 5,513,851 (Harris).

A progressive jackpot is a jackpot that gets bigger until it is won. That is, the jackpot value increases with each game. A progressive jackpot may be funded with a specific additional bet that is placed by a player, or a portion of every bet may be automatically allocated for the progressive jackpot. The Hobart jackpots may be progressive jackpots.

Despite the numerous jackpot schemes that are played during a craps game, there is still an unmet need for a progressive jackpot scheme that entices player interest. The present invention fulfills this need.

Furthermore, there is an unmet need for a three dice version of craps that entices player interest and which can be played separately from, or in conjunction with, a progressive jackpot scheme. The present invention also fulfills this need.

BRIEF SUMMARY OF THE INVENTION

A craps game has a jackpot award. Three dice are used in at least the come-out roll. The craps game includes a progressive jackpot funded with an ante from each player who places a bet in the craps game. The craps game initiates a chance for the current players to win the progressive jackpot whenever a first predetermined outcome occurs in the come-out roll. The progressive jackpot is awarded to the current players if a roll subsequent to the come-out roll having a first predetermined outcome has a second predetermined outcome. The outcome of at least two of the dice in the come-out roll are used to determine the outcome of the craps game only if the come-out roll does not achieve the first predetermined outcome.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
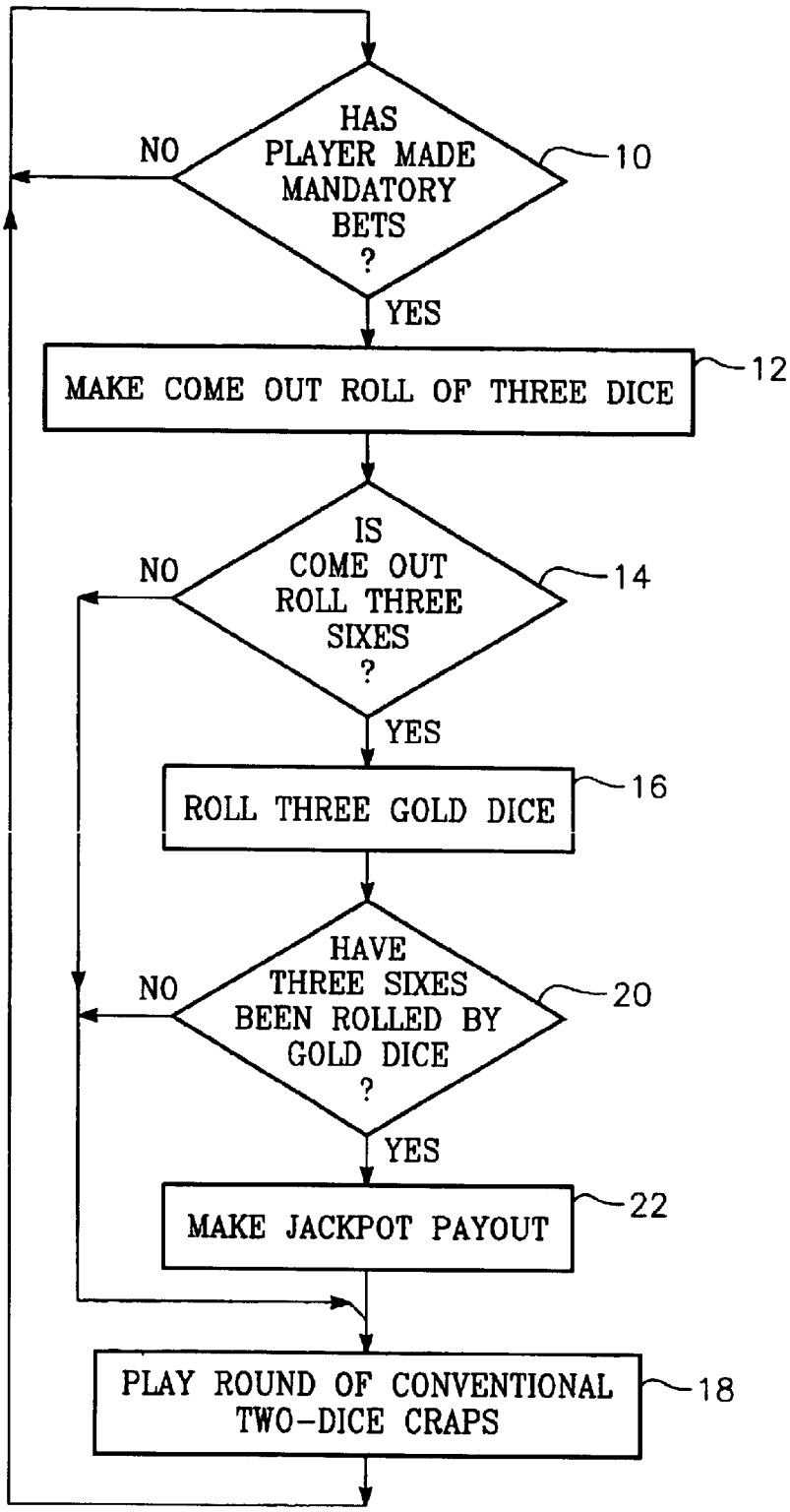
FIG. 1 is a flow diagram of play of a Devil Dice Standard game.

Certain terminology is used herein for convenience only and is not to be taken as a limitation on the present invention. In the drawings, the same reference letters are employed for designating the same elements throughout the several figures.

The invention includes two dice games: a Devil Dice Standard game and a Devil Dice Deluxe game. The Devil Dice Standard game can, for the most part be played with two dice. The Devil Dice Deluxe game is played with three dice. However, the Devil Dice Standard and Devil Dice Deluxe games can be played simultaneously. When such is the case, three dice are always rolled and, when appropriate, one of the die is ignored.

Devil Dice Standard

Except for the come out roll, Devil Dice Standard is played with a pair of conventional Craps dice. The come out roll is an exception, and requires an additional Craps die—such that the initial roll utilizes three dice. As shown in FIG. 1, in accordance with a decision element 10, all players must post mandatory bets. By way of example and not limitation, the mandatory bets comprise an ante of one dollar, and either a pass line bet of at least five dollars or a don't pass line bet of at least five dollars.

As explained hereinafter, aside from these mandatory bets, all subsequent bets of the Devil Dice standard game match those of a two-dice Craps game.

Progressive Jackpot

The decision element 10 is connected to an action block 12. According to the element 10 and the block 12, after the mandatory bets are posted there is a come out roll of three dice. The come out roll is linked to a progressive jackpot through the utilization of the three dice. The progressive jackpot is funded by the ante.

The block 12 is connected to a decision element 14. The decision element 14 is connected to action blocks 16, 18. According to the decision element 14 and the action block 18, when the come out roll is other than three sixes, play of the two-dice Craps continues.

According to the decision element 14 and the action block 16, when come out roll is three sixes, the two-dice Craps game is interrupted for a progressive jackpot roll of three gold (or other specially designated) dice.

The block 16 is connected to a decision element 20. The block 18 and an action block 22 are connected to the element 20. The block 22 is additionally connected to the block 18.

According to the element 20 and the block 18, when the progressive jackpot roll is other than three sixes, play of the two-dice craps continues. However, according to the element 20 and the block 22, when the progressive jackpot roll is three sixes, a payout of a progressive jackpot is equally divided among each of the players. According to the blocks 18, 22, after the payout the two dice Craps continues.

Unlike the jackpots described in the above-identified U.S. patents, the opportunity to win the progressive jackpot of the present invention is initiated in the come-out roll and becomes available to all current players, and the results of the dice roll is used in the craps game if the result is different than a predetermined roll that initiates the progressive jackpot opportunity.

Special Jackpot

Each winner of a progressive jackpot is entered into a pool of eligibility for a special jackpot. In one preferred embodiment, 500 progressive jackpot winners represent an appropriate number of "special jackpot" participants. This number is to be viewed as exemplary and not in any way limiting the scope of the present invention.

As discussed above, upon the occurrence of a progressive jackpot, every player at the table becomes a progressive jackpot winner. Thus the occurrence of a "special jackpot" is dependent upon both the frequency of progressive jackpot winning events and number of table players at such winning events. For example, if the tables play to a 25 player maximum, full tables translate to a requirement of 20 progressive jackpots to obtain the desired pool of 500 eligible "super jackpot" players. In another example, for a 10-player maximum table 50 jackpots will be required (10 times 50), and for a 50-player maximum table, 10 jackpots will be sufficient (50 times 10). Upon reaching the preselected eligible number of progressive jackpot winners, a special jackpot event will then occur to determine a winner of the special jackpot.

Prior to initiating the special jackpot event, those in the pool are notified, such as by e-mail, of their eligibility to participate. Those expressing an interest, such as by sending an e-mail reply on or before the runoff deadline, are assigned a roll number. Preferably, as a live event on the Internet, there is a roll of three platinum dice for each of the roll numbers. At the end of a first selection round, players having roll numbers corresponding to the highest number rolled by the platinum dice become eligible to participate in a second selection round.

Figure 2:
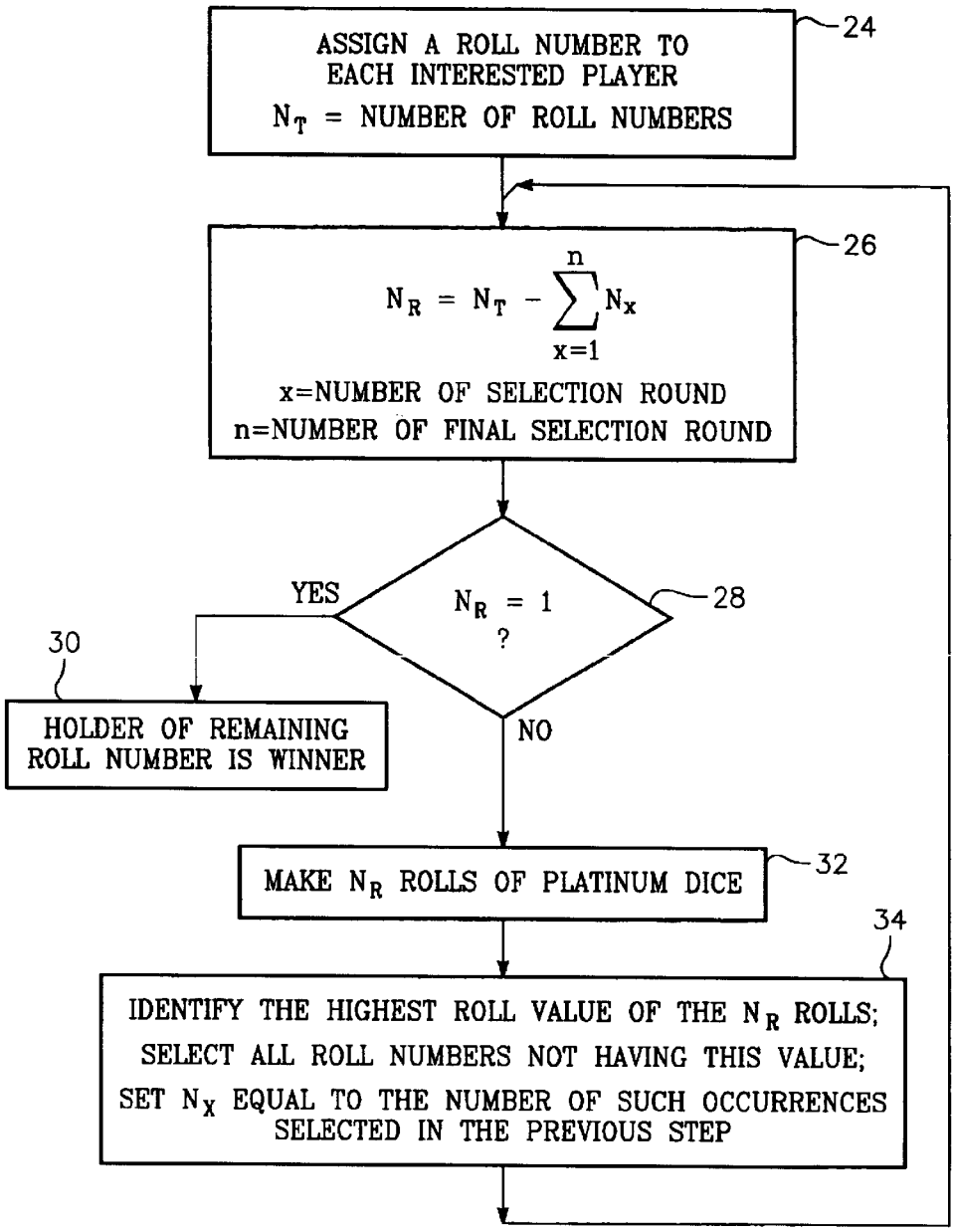
FIG. 2 is a flow diagram of a selection process for selecting a winner of a special jackpot.

As shown in FIG. 2, the assignment of roll numbers is represented by an action block 24 wherein the term, $N_T$, is the number of roll numbers (as noted previously, this number is equal to the number of participants in this Special Jackpot). The block 24 is connected to a subtraction block 26.

The block 26 calls for determining the number of eligible players remaining, as a difference, $N_R$, between the number of roll numbers, $N_T$, and the number of roll numbers that have been eliminated during earlier selection rounds. FIG. 2 makes use of sigma notation in the block 26 to indicate the manner of calculating the number of players that are eliminated in each of the rounds n. Thus, when n=1, the term, $N_X$, is the number of roll numbers that have been eliminated in a first selection round.

A decision element 28 is connected to the block 26. The decision element 28 determines whether all but one of the roll numbers have been eliminated during the prior selection rounds.

The decision block 28 is connected to an action block 30. According to the action block 30, when $N_R$=1 (meaning that only one eligible player remains), that person has been selected to be a contestant in a special jackpot. In other words, when all but a remaining one of the roll numbers have been eliminated during the prior selection rounds, the special jackpot contestant is the player to whom the remaining roll number is assigned.

The decision block 28 is additionally connected to an action block 32. When the difference, $N_R$, is not equal to one, the block 32 calls a number of rolls of the platinum dice equal to the difference, $N_R$. As stated previously, $N_R$ equals the number of players still remaining in the special jackpot selection process.

The block 32 is connected to an action block 34 that calls for determining a number of roll numbers, $N_x$, that have been eliminated because they correspond to roll numbers associated with platinum dice roll results that are less then the highest platinum dice number rolled during a selection round.

The block 34 is connected to the block 26 where the number of eliminated roll numbers, $N_x$, subtracted from the total number of roll numbers $N_T$ is used in determining the difference, $N_R$, which is the number of players remaining eligible for the special jackpot.

In one preferred embodiment, the selected contestant is then awarded with a trip to the location where the final jackpot round will take place, such as, by way of example and not limitation, Panama. Additionally, some ceremonial flourishes are contemplated surrounding this event, such as the utilization of "Devil Dice Assistants" as hostesses and to perform some of the tasks related to carrying out the final jackpot round.

In one preferred embodiment, the final jackpot round consists of three rolls of one die each roll. Upon being provided the die, the player makes Roll 1. If the first dice roll is not a "6," the player wins the number on the dice times a pre-set amount of money, such as, by way of example and not limitation, $500. Thus a roll of "2" would result in an award of $1,000, a roll of "5," an award of $2,500, and so forth.

If the result of Roll 1 is a "6," the player is given a choice of stopping the process and receiving $10,000 or the chance to roll again (Roll 2). If the player chooses to roll again and the second dice roll is not a "6," the player walks away with $2,500. If the result of Roll 2 is a "6," the player is given a choice of stopping, and collecting $100,000, or the chance to roll again (Roll 3). If the player chooses to roll again and the result is not a "6," he or she is awarded $10,000. If the player chooses to roll the final roll and Roll 3 is a "6," the player wins the $1 million Grand Prize. Again, these dollar numbers are for illustrative purposes, and should not be viewed as in any way limiting the scope of this invention.

Devil Dice Deluxe

Devil Dice Deluxe permits the use of three dice beyond the initial or come out roll of the Standard version previously discussed. Whether or not the triple-6 result is accorded "progressive jackpot" status, the use of three dice permits special betting opportunities to be defined for the players. It is presently contemplated that Devil Dice Standard and Devil Dice Deluxe will occur simultaneously, with both sharing the same jackpot, the same table, and the same player limit the three dice will be played on the same table, simultaneously.

Such simultaneous play is preferably enabled by providing dice of two different colors. For example, two of the dice can be of a conventional red coloration, and the third die colored "blue." In this manner it is visually apparent which results affect which bets upon the throw of all three dice. The two "paired dice" provide results that are used to decide conventional Craps bets. The third die is then tied in to the results of the paired dice, and the three dice, taken together, are then used to decide a new set of available wagers.

Triple Combination Bets

With three dice in play, there are six "triple" combinations that can be rolled: 1, 1, 1; 2, 2, 2; 3, 3, 3; 4, 4, 4; 5, 5, 5; and 6, 6, 6. The latter combination defines a progressive jackpot result, as discussed previously, if it occurs on the come out roll. The player may bet on a selected one of the triple combinations being rolled before a roll of the three dice causes the two "paired" dice (red in the example herein) to produce a 7.

When, for example, the bet is on the triple combination 3, 3, 3, and a result of an ensuing roll causes the two red dice to produce a 7 (for example, [3, 4,]3—with "[ ]" indicating the paired (or red) dice), before the triple combination 3, 3, 3 is rolled, the player loses. When the triple combination 3, 3, 3 is rolled before the two red dice produce the 7, the player wins.

The player may bet on "Any Triple Combination" wherein a winning bet occurs where any of the triple combinations is rolled before the two red dice produce a seven. When, for example, the bet is on Any Triple Combination and a result of an ensuing roll causes the two red dice to produce a 7 before one of the triple combinations is rolled, the player loses. When one of the triple combinations is rolled before the two red dice produce the 7, the player wins.

Figure 3:
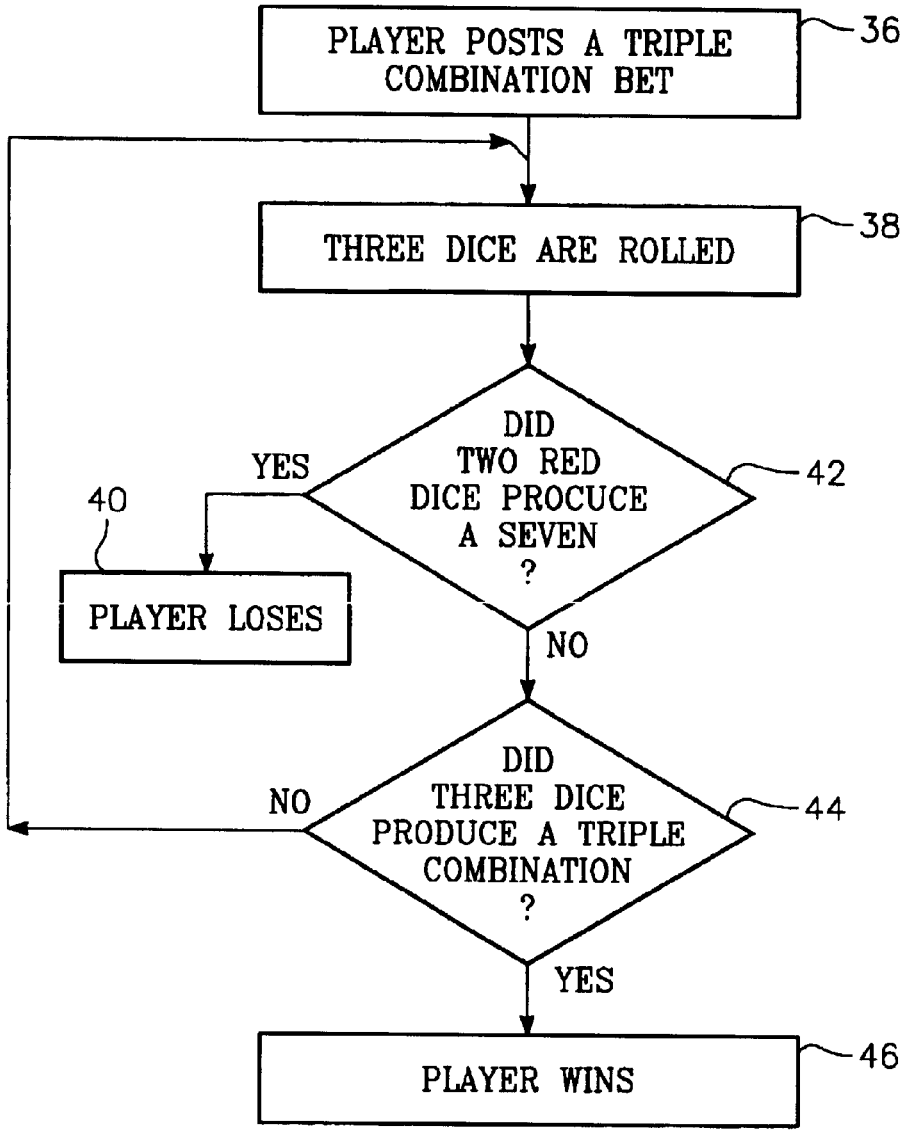
FIG. 3 is a flow diagram of a triple combination bet.

As shown in FIG. 3, in a logic flow diagram of triple combination bets, an action block 36 is connected to an action block 38. According to the blocks 36, 38, a player posts a triple combination bet and the three dice are rolled.

The block 38 and an action block 40 are connected to a decision element 42. According to the blocks 38, 40 and the decision element 42, when the roll of the three dice causes the two red dice to produce the 7, the player loses.

A decision element 44 is connected to the decision element 42, an action block 46 and the block 38. According to the decision element 44 and the block 46, when the roll of the three dice produce the triple combination, the player wins.

According to the decision element 44 and the block 38 when the roll of the three dice does not produce the triple combination, the three dice are once again rolled to determine whether the player wins or loses.

Straight Bets

Since three dice are being rolled, there are four straight combinations that can be rolled; these are 1, 2, 3; 2, 3, 4; 3, 4, 5 and 4, 5, 6. In straight bets described hereinafter, the dice are repeatedly rolled until the player either wins or loses. The player loses when the result of a roll has the two "paired" (red) dice producing a 7.

The player may bet on a selected one of the straight combinations. When, for example, the bet is on the straight combination 3, 4, 5, and a result of a roll is the two red dice producing the 7, (for example, [3, 4,] 5) the player loses. When the straight combination 3, 4, 5 is rolled (for example [3, 5,] 4) the player wins.

The player may bet on "Any Straight", which is a wager on any of the straight combinations, and is won when any of the straight combinations is rolled before the two paired dice achieve a "7". For example, the bet is on Any Straight and a result of a roll is [1, 6,] 3, (the two "paired" or red dice produce a "7"), the player loses. However, had [5, 6,] 4, been obtained prior to the previously displayed result, the player would have won.

Figure 4:
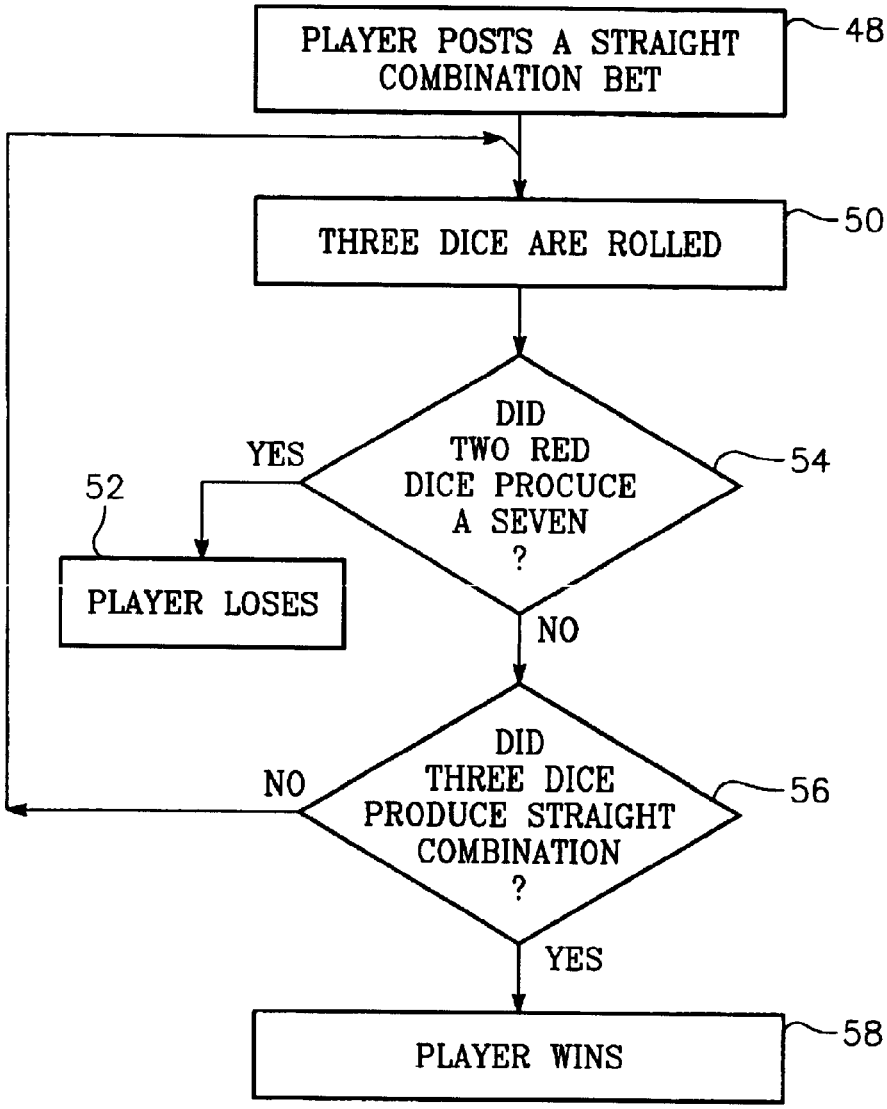
FIG. 4 is a flow diagram of a straight combination bet.

As shown in FIG. 4, in a logic flow diagram of straight bets, an action block 48 is connected to an action block 50. According to the blocks 48, 50, a player posts a straight combination bet and the three dice are rolled.

The block 50 and an action block 52 are connected to a decision element 54. According to the blocks 50, 52 and the decision element 54, when the roll of the three dice causes the two red dice to produce the 7, the player loses.

A decision element 56 is connected to the decision element 54, an action block 58 and the block 50. According to the decision element 56 and the block 58, when the roll of the three dice produce the straight combination, the player wins.

According to the decision element 56 and the block 50, when the roll of the three dice does not produce the straight combination, the three dice are once again rolled to determine whether the player wins or loses.

Straight bets can easily be modified by taking advantage of an easily recognized single die. In one example, a player may bet on a Straight, with the "blue die low," which is won when any of the straight combinations are rolled, with the blue die producing the lowest number of the straight. In another example, a Straight, blue die low, bet is made, and the result of a roll is [3, 4,]2 (the two red dice producing a "7"), the player loses. Alternatively, when a roll produces the straight combination, 1, [2, 3], with the blue die producing the 1, the player wins.

The player also may bet on a "blue die middle" straight, which is won when any of the straight combinations are rolled, with the blue die producing the middle number of the straight combination. For example, when the bet is on the "blue die middle" straight and a result of the roll is the two red dice producing a "7" (for example [3, 4], 5,), the player loses. When the straight combination, [3, 5], 4, with the blue die producing the "4," the player wins.

The player may bet on a "blue die high" straight, which is won when any of the straight combinations are rolled, with the blue die producing the highest number of the straight combination. For example, when the bet is on "blue die high" straight and a result of a roll is the two red dice producing a "7" ([3, 4], 5), the player loses. When the straight combination, [1, 2,] 3, with the blue die producing the "3," is rolled, the player wins.

Since three dice are being rolled, there are two "skip" Straight combinations that can be rolled; these are [1, 3], 5 (referred to as a "skip straight low") and [2, 4], 6 (referred to as a "skip straight high"). The player may bet on a selected one of the skip straight combinations, with a winning result possible unless the two red dice first produce a value of "7". For example, the player wagers on a "skip straight low" and before that event occurs, the two red dice produce a "7", the player loses. However, if the combination [1, 3], 5 is first rolled, the player wins.

Red Dice Add Up To Blue Die Bets

The player may bet "Any Red Dice Add Up To Blue Die" meaning that when the dice are rolled, the two red dice produce numbers having a sum that equals a number produced by the blue die (for example [2, 4], 6). The dice are repeatedly rolled until the player either wins or loses. The player loses when the two red dice produce "7". Some additional examples might include, a roll causes one red die to produce a 2, the other red die to produce a 3 and the blue die to produce a 5: the player wins.

Figure 5:
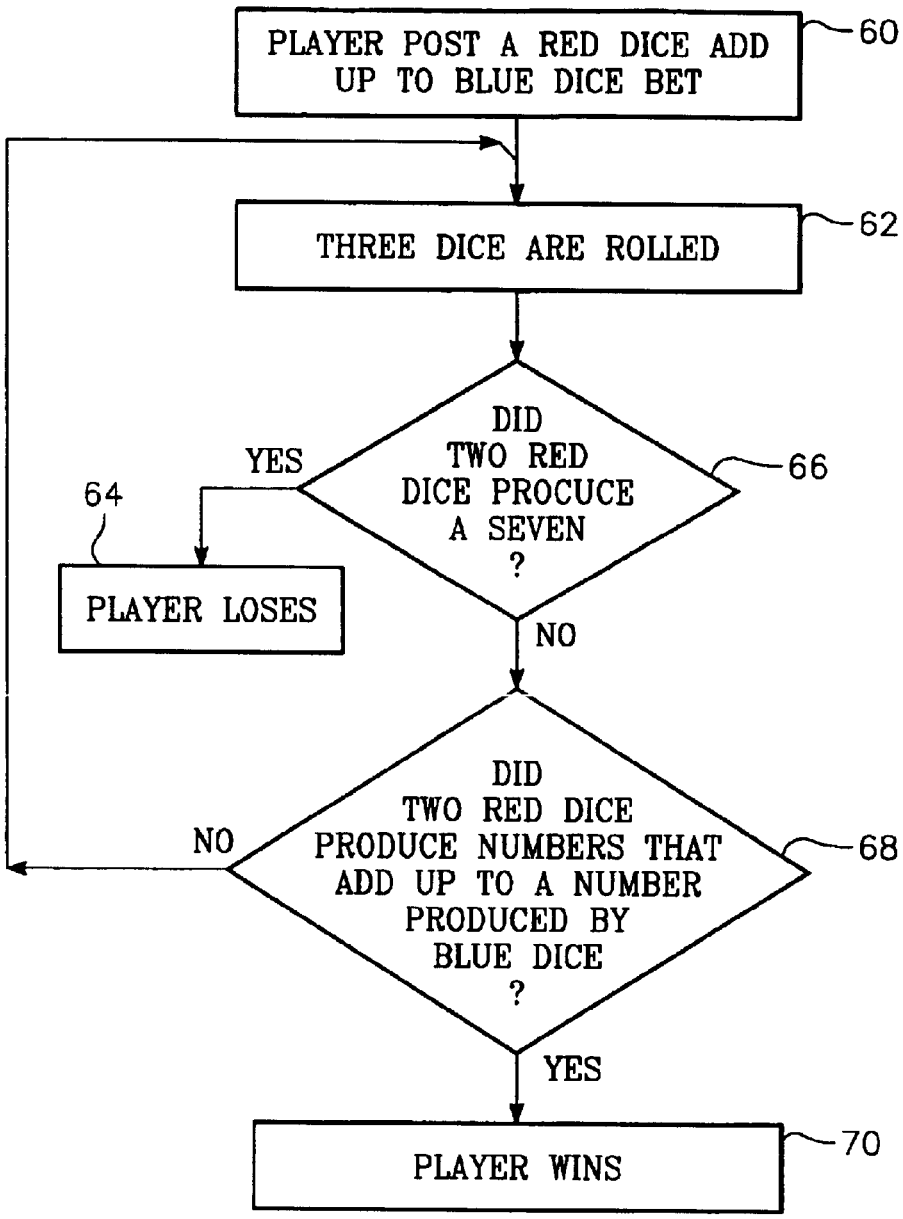
FIG. 5 is a flow diagram of a red dice add up to blue die bet.

As shown in FIG. 5, in a logic flow diagram of red dice add up to blue die bets, an action block 60 is connected to an action block 62. According to the blocks 60, 62, a player posts a red dice add up to blue die combination bet and the three dice are rolled.

The block 62 and an action block 64 are connected to a decision element 66. According to the blocks 62, 64 and the decision element 66, when the roll of the three dice causes the two red dice to produce the 7, the player loses.

A decision element 68 is connected to the decision element 66, an action block 70 and the block 62, According to the decision element 68 and the block 70, when the roll of the three dice cause the two red dice produce numbers that add up to a number produced by the blue die, the player wins.

According to the decision element 68 and the block 62 when the roll of the three dice does not cause the two red dice produce numbers that add up to a number produced by the blue die, the three dice are once again rolled to determine whether the player wins or loses.

The player also may wager on particular winning combinations, such as the following:

(1) the blue die producing a 2 and the red dice producing any combination that has a sum of 2;

(2) the blue die producing a 3 and the red dice producing any combination that has a sum of 3;

(3) the blue die producing a 4 and the red dice producing any combination that has a sum of 4;

(4) the blue die producing a 5 and the red dice producing any combination of 5; and (5) the blue die producing a 6 and the red dice producing any combination of 6.

Once a point has been establish, the above-listed Devil Dice Deluxe bets play like the same types of available wagers in conventional craps. For example, a triple 3, 3, 3 bet is won if the combination 3, 3, 3 is rolled before a red dice "7." However, if, for example, a point of "5" has been established, and the "5" is rolled before a "7," the triple bets are "off" on the next come out roll unless otherwise specified by the player.

One Roll Bet

The player at any time may make a "one roll" bet. In this case any of the above available bets can be selected as a "one roll" bet, and they are won or lost on the results of the next roll. If the particular result matches the players wagered result, the player wins-any other result and the player loses the "one roll" bet.

Over/Under One Roll Bet

This wager can be made by betting on a particular number and over or a particular number and under. The number is the sum of the three dice on the very next dice roll. Example: The player bets on 8 or over. If on the next roll the sum of the three dice adds up to 8 or more, the player wins his or her bet. If on the other hand, the player makes the same wager and the sum of the three dice adds up to 7 or less, the player loses his or her bet. Again, this bet is a one roll bet and can be placed at anytime.

Parlays

Parlays are multi roll bets of at least two rolls and as many rolls as will be offered for the particular parlay. There may be any number of roll limits. There are two types of parlays that are offered.

a. Parlay 1 is called "Parlay a Number."

This parlay is based on placing a bet that a particular number (between 1 and 6) will appear at least on one of the dice during each subsequent roll of all three dice up to n number of rolls where n is chosen by the player and must be 2 or more rolls. For example, if the particular number to be rolled is 5 and the number of rolls chosen by the player is three rolls, then in order for the bet to win a 5 must appear on at least one dice over the next three rolls. If not, the player loses his bet.

b. Parlay 2 is called "Parlay the Sum."

This parlay is a bet in which a player chooses a particular sum of all three dice to be achieved during each subsequent roll up to n number of rolls where n is chosen by the player and must be 2 or more rolls. For example, a player may choose to parlay the Sum of 9 over 4 rolls. In order for the bet to win, the sum of the dice for the next 4 rolls must equal 9. If not, the player loses.

Game Logistics

Figure 6:
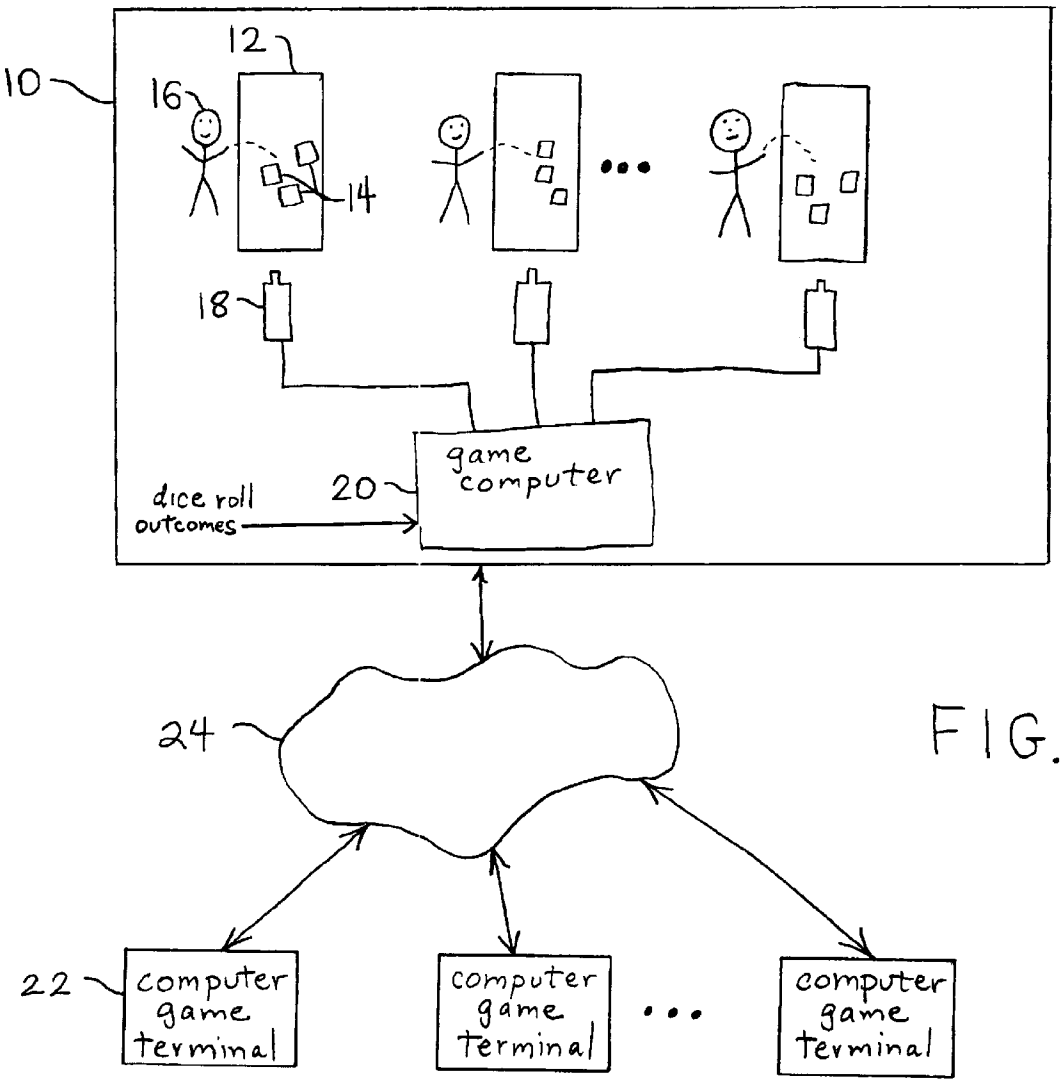
FIG. 6 is a schematic block diagram of a system in accordance with one preferred embodiment of the present invention.

FIG. 6 is a schematic block diagram of a system in accordance with one preferred embodiment of the two Devil Dice games wherein a plurality of players participate in a live casino-style game hosted by a game operator, such as a hotel casino. The live game and the special jackpot event are both played at one or more sites 10 that are physically remote from some or all of the players. One or more tables 12 are located at each physically remote site 10. Dice 14 are thrown onto the tables 12 by game attendant 16. A video camera 18 is aimed at each table 12 and captures live video of the dice rolls. The outcome of each dice roll is entered into a game computer 20 for use in determining player payouts. The game computer 20 also receives the output of the video camera 18 and prepares a live streaming video image of the dice roll activity at each of the tables 12. The live video allows for archival storage of dice rolls. The live video, in combination with statistical analysis of dice outcomes, allows for accurate auditing, thereby reducing the likelihood of cheating by the game operator. The ability to guarantee a "clean" game will result in greater player interest and participation.

To participate in the live game, a player uses a computer game terminal 22 (user interface) to connect to the Devil Dice game computer 20 via a wired or wireless communication medium 24 (e.g., phone, cable, satellite). The computer game terminals 22 may be located anywhere in the world, including a public or private area of the game operator's site 10. Some computer game terminals 22 may also be personal computers. Some computer game terminals 22 may have browsers for connecting to the game computer 20 via the Internet.

The screen of the computer game terminals may include a simulated craps table that shows player bets, game status and dice roll outcomes, in addition to live video of the actual game that the player is participating in. The progressive jackpot is easily tracked since all antes and wagers of participating players are electronically entered into the game computer 20.

The dice rolling tables 12 may be specially designed tables for ensuring fair and easily viewable dice rolling for video capture. Alternatively, the dice rolling tables 12 may be actual craps tables. Since there is no live participation by players at the craps tables (i.e., no physical chips are placed on the tables), it is not necessary to use actual craps tables. If actual craps tables are used in the Devil Dice Deluxe game, the craps tables must be modified to provide areas for the additional potential wagers.

In the example described above wherein a table has a 25 player maximum, each table allows for 25 players to electronically participate. The number of active tables are determined by supply and demand and the optimal or desired queue (waiting) time for players that want to enter a game, which is determined by the game operator.

In an alternative embodiment, the Devil Dice games are played live at actual craps tables and players participate in the game by being physically present and placing antes and wagers on the craps tables. In this embodiment, players who win the progressive jackpot must register with the game operator so that their eligibility to participate in the subsequent special jackpot events can be tracked and verified. Also, the antes must be electronically tracked to maintain an accurate, real-time accounting of the progressive jackpot which may be won at any of a plurality of simultaneously active tables.

The present invention may be implemented with any combination of hardware and software. If implemented as a computer-implemented apparatus, the present invention is implemented using means for performing all of the steps and functions described above.

The present invention can be included in an article of manufacture (e.g., one or more computer program products) having, for instance, computer useable media. The media has embodied therein, for instance, computer readable program code means for providing and facilitating the mechanisms of the present invention. The article of manufacture can be included as part of a computer system or sold separately.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A method of playing a craps game that includes a progressive jackpot, wherein three dice are used in at least the come-out roll, the method comprising:

(a) funding the progressive jackpot with an ante from each player who places a bet in the craps game;

(b) initiating a chance for the current players to win the progressive jackpot whenever a first predetermined outcome occurs in the come-out roll;

(c) awarding the progressive jackpot to the current players if a roll subsequent to the come-out roll having a first predetermined outcome has a second predetermined outcome; and (d) using the outcome of at least two of the dice of the come-out roll to determine the outcome of the craps game only if the come-out roll does not achieve the first predetermined outcome.

2. The method of claim 1 further comprising:

(e) holding a special jackpot event, wherein all players who won the progressive jackpot over a number of the successive craps games are eligible for playing the special jackpot event, the special jackpot event conducting one or more successive elimination rounds, each round:

(i) assigning a unique dice roll number to each eligible player who chooses to participate in the special jackpot event, the total number of dice rolls for each round thereby being equal to the total number of participating players in the round, and (ii) selecting the players with the same highest dice roll sums to advance to a successive round; and (f) selecting the special jackpot winner to be the last player that remains from the elimination rounds.

3. The method of claim 2 further comprising:

(g) holding a final jackpot round for the special jackpot winner, the final jackpot round being a predetermined number of successive rolls of one die per roll, the award being determined by:

(i) a multiple of the dice outcome if the first die roll is not a "6";

(ii) a successively increasing jackpot amount if each of the dice rolls is a "6", each round offering a choice to the special jackpot winner to discontinue the game and retain some or all of the previously won jackpot amount or continue to play and risk losing some or all of the previously won jackpot amount.

4. The method of claim 1 wherein the first predetermined outcome is a roll of three sixes.

5. The method of claim 4 wherein the second predetermined outcome is a roll of three sixes.

6. The method of claim 1 further comprising:

(e) a game attendant rolling the dice onto an unmarked table to determine the outcome of a roll; and (f) at least some of the players placing their antes and bets via electronic game terminals.

7. The method of claim 6 further comprising:

(g) capturing live video of the dice roll onto the table; and (h) providing the live video to the players at the electronic game terminals.

8. The method of claim 1 wherein the progressive jackpot is awarded by being evenly split among the current players.

9. The method of claim 1 wherein the subsequent roll occurs immediately after a roll where the first predetermined outcome occurs in a come-out roll.

10. The method of claim 1 wherein two dice are a first color and the third die is a second color, and step (d) further comprises using the outcome of the two dice having the same first color to determine whether there is a win, loss, or whether a new point number is established if the come-out roll does not achieve the first predetermined outcome.

11. The method of claim 1 further comprising:

(e) using a different set of dice for the roll subsequent to the come-out roll having a first predetermined outcome.

12. The method of claim 1 wherein the dice are rolled only by game attendants.

13. The method of claim 1 wherein the ante includes a fixed first monetary value and either a pass line bet or a don't pass line bet of at least a second monetary value.

14. The method of claim 1 wherein the ante is mandatory.

* * * * *